US007074996B2

(12) United States Patent
Simons et al.

(10) Patent No.: US 7,074,996 B2
(45) Date of Patent: Jul. 11, 2006

(54) DRUM HEAD ASSEMBLY AND METHOD OF TENSIONING A DRUM HEAD

(75) Inventors: Richard Simons, Garfield, NJ (US); Andrzej Krol, Lincoln Park, NJ (US); Raymond Enhoffer, Clifton, NJ (US)

(73) Assignee: Latin Percussion Inc., Garfield, NJ (US)

( * ) Notice: Subject to any disclaimer, the term of this patent is extended or adjusted under 35 U.S.C. 154(b) by 63 days.

(21) Appl. No.: 10/638,122

(22) Filed: Aug. 8, 2003

(65) Prior Publication Data

US 2004/0094015 A1 May 20, 2004

Related U.S. Application Data

(60) Provisional application No. 60/401,956, filed on Aug. 8, 2002.

(51) Int. Cl.
*G10D 13/02* (2006.01)

(52) U.S. Cl. ..... 84/413; 84/411 R

(58) Field of Classification Search ..... 84/413, 84/411 R, 411 A

See application file for complete search history.

(56) References Cited

U.S. PATENT DOCUMENTS

| | | | | |
|---|---|---|---|---|
| 2,165,379 A | | 7/1939 | Hiers | |
| 3,264,926 A | | 8/1966 | Belli | |
| 4,283,985 A | | 8/1981 | Famularo | 84/411 R |
| 4,520,709 A | * | 6/1985 | Kester, Jr. | 84/415 |
| 4,833,964 A | * | 5/1989 | Prouty | 84/411 R |
| 4,869,146 A | | 9/1989 | Bonsor | 84/413 |
| 4,979,422 A | * | 12/1990 | Belli | 84/414 |
| 5,031,499 A | * | 7/1991 | Wang | 84/411 M |
| 5,811,709 A | * | 9/1998 | Adinolfi | 84/723 |
| 6,184,451 B1 | | 2/2001 | Miller et al. | 84/411 R |
| 6,417,432 B1 | | 7/2002 | Downing | 84/411 R |

* cited by examiner

*Primary Examiner*—Marlon T. Fletcher
*Assistant Examiner*—Jianchun Qin
(74) *Attorney, Agent, or Firm*—Ohlandt, Greeley, Ruggiero & Perle, L.L.P.

(57) ABSTRACT

There is provided a drum head assembly. The drum head assembly has an outer member and an inner member. The outer member has an L-shaped step on its inside surface with posts extending outward from the base of the step. The depth of the inside edge of the outer member determines the amount of tension on the head. A die cut head or skin with holes punched to match the posts is inserted into the outer member. The inner member with holes that match the posts in the outer member is pressed onto the underside of the outer member. The pressure forces the inner member into the inside edge of the L-shaped inside surface of the outer member. There is also provided a method in which the die cut head or skin gets pulled at the same time, thus creating tension. While the assembly is still under pressure, a heated mandrel melts the post ends onto the inner member, thus holding the three components of the assembly in place.

44 Claims, 7 Drawing Sheets

DRUM HEAD ASSEMBLY AND METHOD OF TENSIONING A DRUM HEAD

CROSS REFERENCE TO RELATED APPLICATIONS

The present application is claiming priority of U.S. Provisional Patent Application Ser. No. 60/401,956, filed on Aug. 8, 2002, the disclosure of which is incorporated in its entirety by reference.

BACKGROUND OF THE INVENTION

1. Field of the Invention

The present invention relates to percussion musical instruments. In particular, the present invention relates to tensioned drum head assemblies that are self-contained and that allow for varied head tension. The present invention also includes a method for tensioning a drum head assembly without using any glue or adhesive.

2. Description of the Prior Art

Various types of drum heads and drum head mounting assemblies are known in the art of musical instruments. Typically, a drum head, vibrating membrane or skin (so-called whether made of animal skin or synthetic material), is drawn over the open top (and/or bottom) of a drum body and is attached to the exterior of the drum body by tacks or hooks. While generally satisfactory, this type of drum has been found to have certain drawbacks. For example, these types of drum heads typically have bulky rims and external attachment hardware that is aesthetically undesirable, and that can impede unrestrained play, particularly play by hand, by presenting hard, irregular, and protruding surfaces that the player is likely to hit.

Traditional drum head assemblies also typically have tensioning hardware that is located externally, where it limits the player's ability to play. This hardware can be a safety hazard, and is not aesthetically desirable. Although internal tensioning devices are known, they are generally difficult to access and manipulate.

Traditional drum head assemblies are generally round in configuration. Additionally, due to their design and configuration, there is stress placed on traditional drum shells or frames and, consequently, the shells tend to be made from relatively expensive materials that can withstand the stress.

Consequently, there exists a need for a tensioned drum head assembly that is self-contained, inexpensive to manufacture, and may be shaped other than in the traditional round configuration. There is also a need for a drum head assembly in which all the tension is self-contained in the assembly and where no stress is placed on the drum shell or frame. Finally, there exists a need for a drum head assembly that has the aforementioned features, and which allows for two or more of the same size assemblies to be pitched or tensioned differently.

SUMMARY OF THE INVENTION

It is an object of the present invention to provide a drum head assembly where the drum head tension is self-contained.

It is another object of the present invention to provide such a drum head assembly where the drum head tensioning assembly is accomplished without requiring any glue or adhesive.

It is still another object of the present invention to provide such a drum head assembly where no stress is placed on the drum shell or frame, allowing the shell to be made from less expensive material such as composite paper, thin wood or plastic.

It is yet another object of the present invention to provide such a drum head assembly that allows for varied head tension in that two or more of the same size assemblies can be tensioned differently.

It is a further object of the present invention to provide such a drum head assembly where the method of tensioning the drum head assembly allows varied shapes other than the traditional round shape.

It is still a further object of the present invention to provide a method for tensioning a drum head assembly without using any glue or adhesive, yet placing adequate tension to produce a traditional drum sound, while allowing for all tension to be self-contained in the assembly with no stress being placed on the drum shell or frame.

These and other objects and advantages of the present invention are achieved by a drum head assembly that has two rings or members. An outer ring is L-shaped. The inside surface of the L-shape or step has a base and a vertically perpendicular arm. The base has posts or pins extending outward. The depth of the inside edge of the outer ring determines the amount of tension on the head. A die cut head or skin with holes punched to match the posts or pins is inserted into the outer ring. An inner ring with a protruding arm and with holes that match the posts in the outer ring is pressed onto the assembly. The pressure forces the inner ring towards the inside edge of the outer ring, while the protruding arm presses the head or skin. The die cut head gets pulled at the same time, thus creating tension. While the assembly is still under pressure, a heated mandrel melts the post ends onto the inner ring, thereby holding everything in place.

BRIEF DESCRIPTION OF THE DRAWINGS

These and other embodiments of the present invention will be appreciated by referring to the drawings that include.

DETAILED DESCRIPTION OF THE INVENTION

Figure 1:
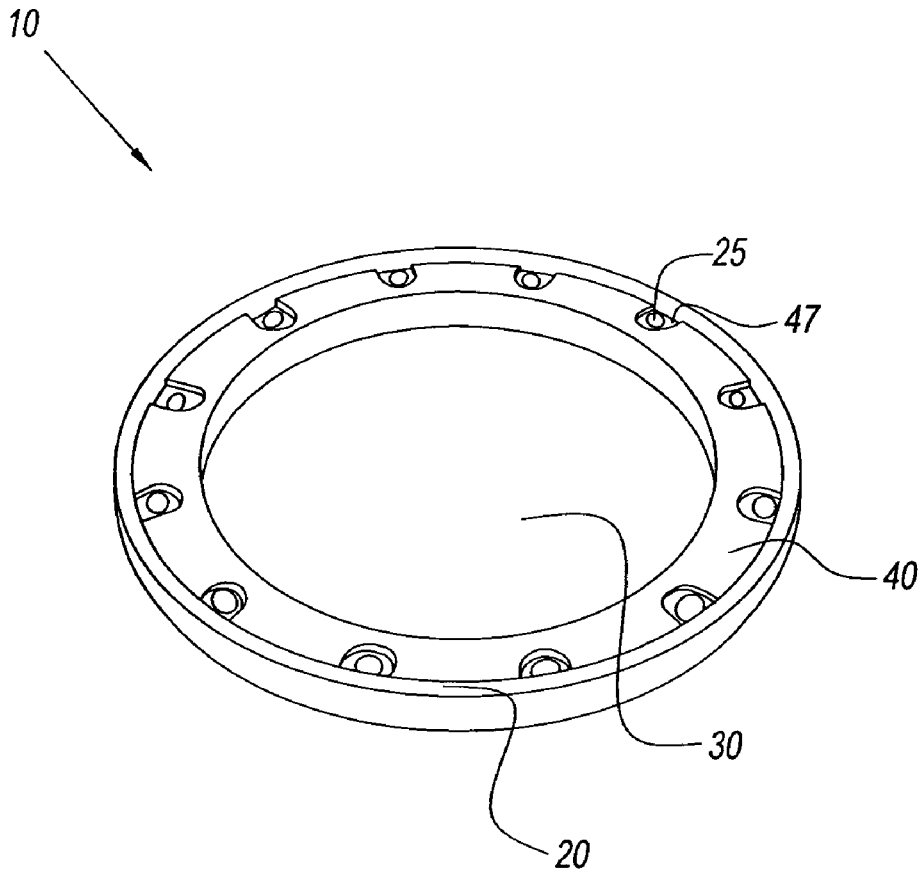
FIG. 1 is a bottom perspective view of an assembled drum head assembly of the present invention.

Referring to the drawings and, in particular, FIG. 1, there is shown a preferred embodiment of a drum head assembly generally referred to by reference numeral 10. The drum head assembly 10 includes an outer member 20, a skin 30, and an inner member 40. Collectively, these elements make up drum head assembly 10.

Figure 2:
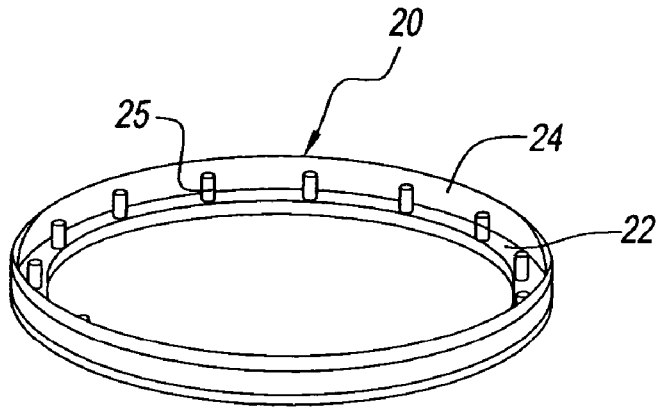
FIG. 2 is a bottom perspective view of the outer member of the drum head assembly of FIG. 1.
Figure 3:
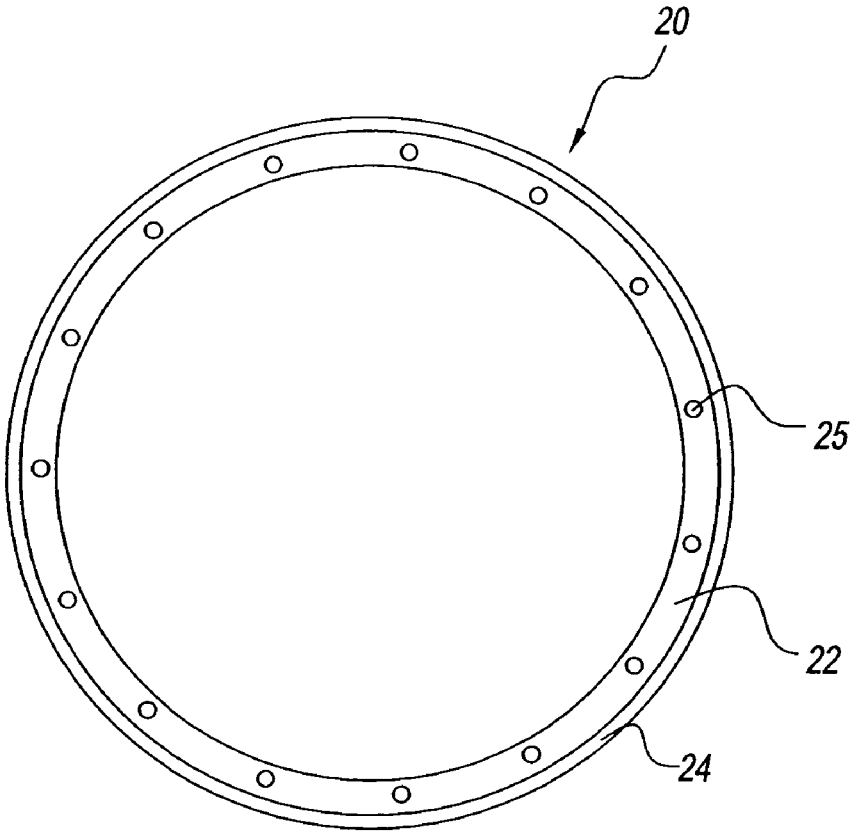
FIG. 3 is a bottom plan view of the outer member of the drum head assembly of FIG. 1.

Preferably, outer member 20 may be shaped to resemble a drum rim, and is sized such that drum head assembly 10 can be mounted over the open top of a drum body (not shown) to form a complete drum assembly. As shown in FIGS. 2 and 3, outer member 20 is preferably substantially ring-shaped and can be mounted on a traditionally cylindrical drum body or shell. However, in alternative embodiments, outer member 20 and, consequently, inner member 40, drum head assembly 10, as well as the drum body, may be in a shape other than the traditional round shape (i.e. may be square, triangular, animal-shaped, etc.).

As shown in FIGS. 2 and 3, outer member 20 preferably has an L-shape. Outer member 20 includes an inner surface having an L-shaped step. The L-shaped step has a base or surface 22 and an arm 24 virtually perpendicular to the bottom surface. The base or bottom surface 22 of outer member 20 has at least six rounded posts 25 integrally connected to the bottom surface and extending outward. Preferably, outer member 20 has about sixteen posts 25. Also preferably, posts 25 are equally spaced apart. The L-shaped inner surface and posts 25 of outer member 20 are designed to accept and engage skin 30 and inner member 40.

Figure 4:
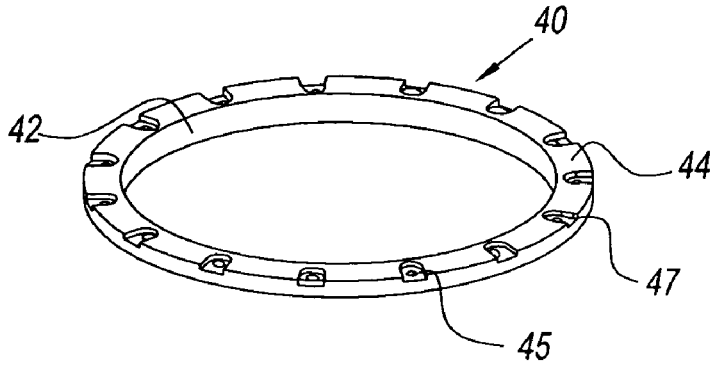
FIG. 4 is a bottom perspective view of the inner member of the drum head assembly of FIG. 1.
Figure 5:
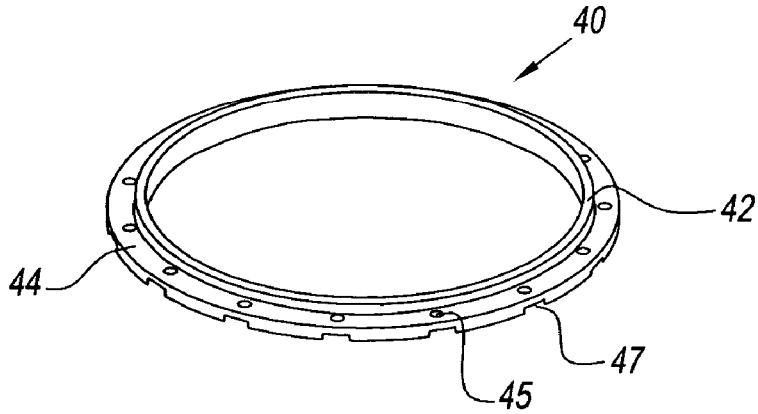
FIG. 5 is a top perspective view of the inner member of the drum head assembly of FIG. 1.
Figure 6:
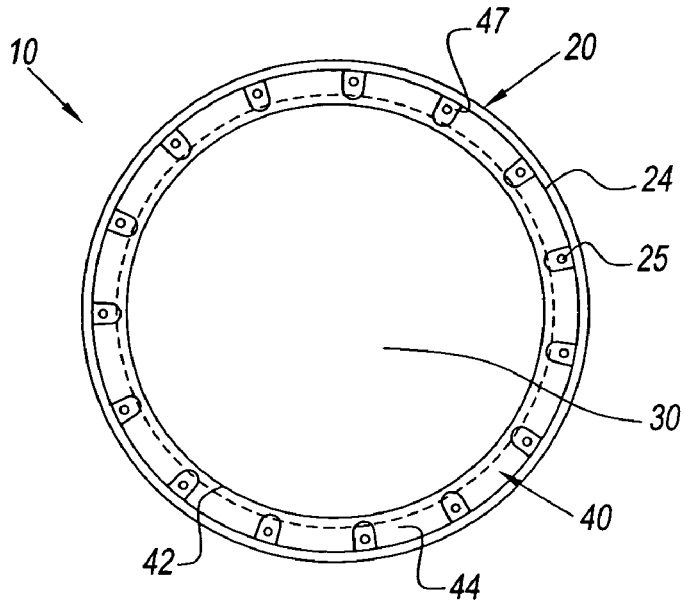
FIG. 6 is a bottom plan view of the assembled drum head assembly of FIG. 1.
Figure 7:
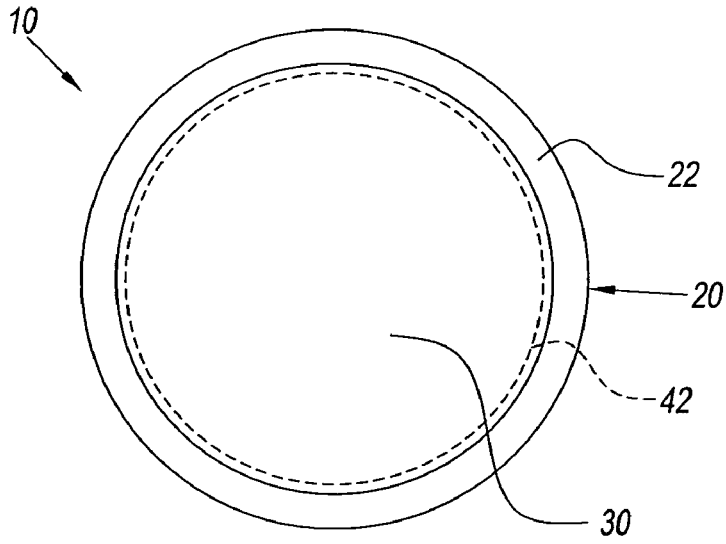
FIG. 7 is a top plan view of the assembled drum head assembly of FIG. 1.

As shown in FIGS. 4 and 5, inner member 40 has a similar and complementary shape configuration as outer member 20. Inner member 40 is preferably also ring-shaped and its top surface can engage the bottom surface of outer member 20. The outer circumference of inner member 40 is approximately equal to, but slightly less than, the inner circumference of arm 24 of outer member 20, thereby providing for mating of the two, such that they are concentrically aligned. As shown in FIGS. 4 and 5, inner member 40 preferably has an L-shaped structure on its outer surface. Preferably, inner member 40 has an arm 42 formed, preferably integrally, on its inner circumference, extending perpendicular, or virtually perpendicularly from a base surface 44. Preferably, inner member 40 also has a number of apertures 45 axially formed through base surface 44. The number of apertures 45 is at least equal in number to the posts 25 of outer member 20. Arm 42 is preferably positioned on the inner circumference of inner member 40 on the side of apertures 45 that is away from the outer circumference. Thus, inner member 40 can generally matingly engage outer member 20. As shown in FIGS. 6 and 7, when assembled, arm 42 becomes the inner ring of the drum head assembly.

Preferably, as shown in FIGS. 4 and 5, the bottom side of base surface 44 of inner member 40 has a number of sunken C-shaped grooves 47, each positioned about a different aperture 45. In a preferred embodiment, the number of grooves 47 is equal to the number of apertures 45. As shown in FIGS. 4 and 5, each groove 47 surrounds an aperture 45. Preferably, the open end of each groove 47 is positioned on the outside surface of inner member 40.

Figure 8:
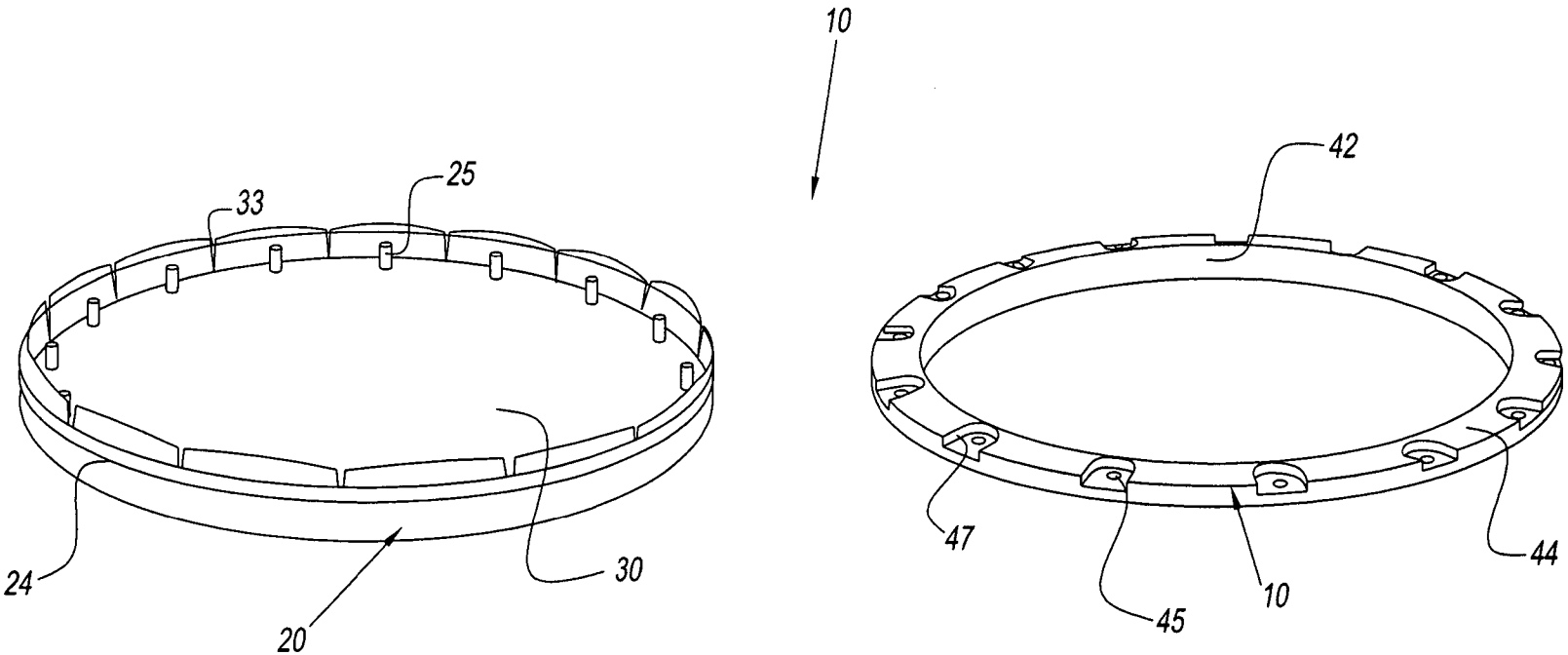
FIG. 8 is a bottom perspective views of the outer and inner members of the drum head assembly of FIG. 1, with a skin positioned within the outer member.
Figure 10:
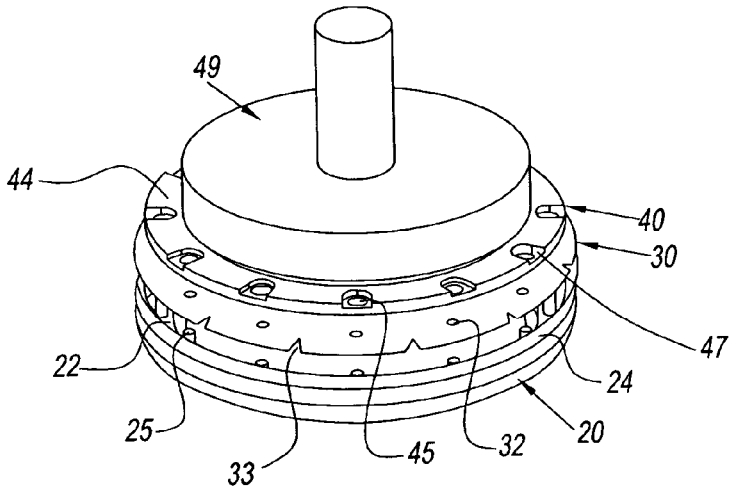
FIG. 10 is an exploded view of the drum head assembly of FIG. 1, depicting a press ram pressing the inner member and skin into the outer member.

As shown in FIGS. 8 and 10, in a preferred embodiment, a die cut skin 30, with round holes 32 punched to match posts 25, is positioned onto the bottom surface 22 of outer member 20. Holes 32 in skin 30 affect the tension of drum head assembly 10. Therefore, holes 32 are configured to easily place skin 30 over posts 25, but without skin 30 being loose or sagging. Preferably, the circumference of skin 30 is greater than the circumference of outer member 20. Preferably, as shown in FIG. 8, skin 30 also has a plurality of radial slits 33 that are evenly spaced along its circumference to assist in maintaining the skin surface flat when the skin's outer edge is folded upwards along the inside surface of outer member 20.

Figure 9:
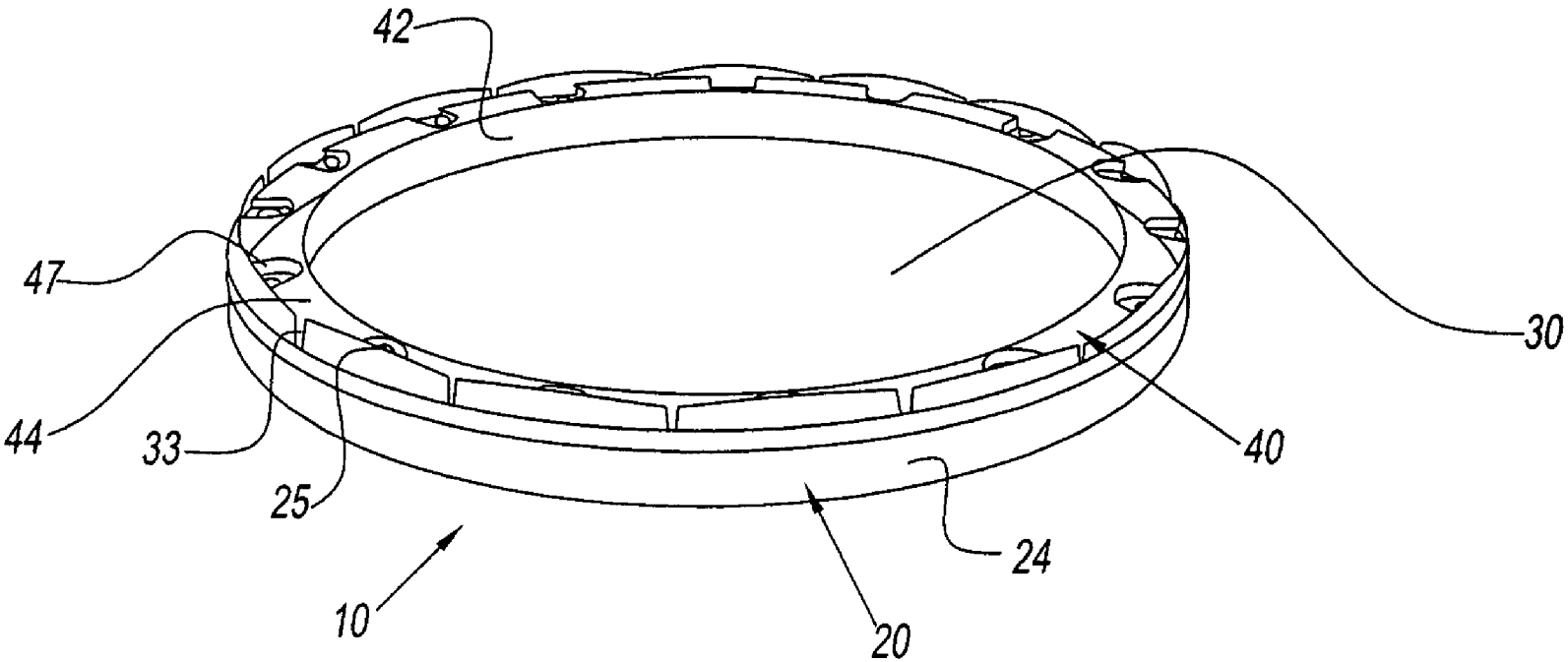
FIG. 9 is a bottom perspective view of the outer member, inner member and skin of the drum head assembly of FIG. 8, with the skin and inner member positioned and engaged with the outer member.

As shown in FIGS. 9 and 10, base surface 44 of inner member 40 is pressed towards and onto bottom surface 22 of outer member 20. Bottom surface 22 and arm 24 of outer member 20 form an inside edge. The pressure from pressing inner member 40 forces base surface 44 of inner member 40 towards the inside edge of outer member 20. Arm 42 is forced against skin 30 thus providing tensioning to skin 30 that is anchored by posts 25. Thus, the amount that arm 42 is forced against skin 30 affects the amount of tension on the skin. It should be noted that if skin 30 were absent, inner member 40 would rest in outer member 20 such that the free edge of arm 42 would be flush with the outside surface, shown in FIG. 3, of outer member 20. In normal operation, arm 42 becomes the inner ring of the assembly as shown in FIGS. 6 and 7. During assembly, the die cut skin 30 gets pulled at the same time, thus creating tension. The depth of the inside edge of outer member 20, along with the position of arm 42 with respect to outer member 20, determines the amount of tension on skin 30. Additionally, the greater the number of posts 25 that are present on outer member 20, the greater the amount of anchoring and, thus, the greater the tension that will be created on skin 30. For these reasons, two or more of the same size assemblies can be pitched or tensioned differently.

As shown in FIG. 10, a press ram 49 is preferably used to press inner member 40 and skin 30 into outer member 20. Preferably, after assembly and pressing, any outer portion of skin 30 that protrudes from the drum head assembly 10, as shown in FIG. 9, is trimmed to be flush with the bottom surface of inner member 40 to allow for a flush fit between drum head assembly 10 and the drum body or shell.

Figure 11:
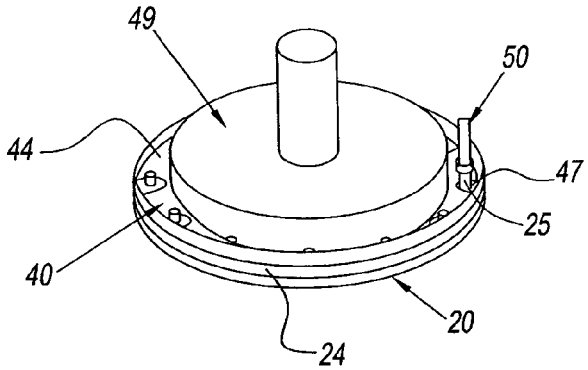
FIG. 11 is an exploded view of the drum head assembly and press ram of FIG. 10, depicting a heated mandrel melting the pins of the outer member.
Figure 12:
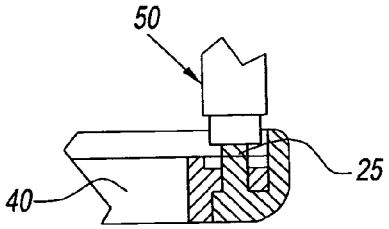
FIG. 12 is a simplified sectional view of the drum head assembly of FIG. 11, depicting a heated mandrel melting a pin of the outer member.
Figure 13:
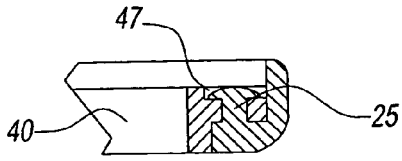
FIG. 13 is a simplified sectional view of the drum head assembly of FIG. 12, depicting a pin of the outer member subsequent to the pin's melting by a heated mandrel.

In a preferred embodiment as shown in FIG. 11, while outer member 20, inner member 40, and skin 30 are pressed together, a heated mandrel 50 is used to melt the protruding portions of posts 25 and to form a head on each of the posts before the pressure is released. Preferably, as shown in FIGS. 12 and 13, heated mandrel 50 is used to melt posts 25 and to form heads that do not extend outside grooves 47 of inner member 40. Therefore, no glue or adhesive is necessary to maintain the two members together and consequently the tension. However, glue may optionally be applied in grooves 47 for reinforcement.

Outer member 20 and inner member 40 may be made from any material. Preferably, outer member 20 and inner member 40 are made from plastic, metal, or a combination of both. Skin 30 may be any vibrating membrane known in the art and can be made from any traditional drum head, film or skin material. Skin 30 can be made of animal skin, natural or synthetic material. Skin 30 can be made of any thin material such as plastic, polyester, MYLAR, fabric, animal skin, or combinations of these (such as vinyl-coated fabrics). Preferably, skin 30 is made from a polyester film. A preferred film is MYLAR, a trademark of DuPont Corporation. Because all of the tension is self-contained in drum head assembly 10, no stress will be placed on the drum body, shell or frame. This feature allows any drum body, shell or frame used with drum head assembly 10 to be made from a less expensive material such as composite paper, thin wood or plastic.

As described above, and as shown in FIGS. 1, 6, 7, and 10 to 13, there is also provided a method for tensioning a drum head assembly. Drum head assembly 10 has an outer member 20 and an inner member 40. Outer member 20 has an L-shaped step on its inside surface. Outer member 20 has bottom surface 22 with posts 25 extending outward. The depth of the inside edge of outer member 20 along with the number of posts 25, in part determines the amount of tension on the head. A die cut head or skin 30 with holes 32 punched to match posts 25 is inserted into outer member 20. Inner member 40 with apertures 45 that match posts 25 in outer member 20, and having an L-shaped structure on its outer surface, is pressed onto the bottom surface 22, and slides concentrically against arm 24 of outer member 20. The pressure forces inner member 40 into the inside edge of outer member 20. Preferably, base surface 44 is pressed towards bottom surface 22 while arm 42 presses skin 30 and becomes the inner ring of the assembly. The die cut skin 30 gets pulled at the same time, thus creating tension and affecting the amount of tension. While the assembly is still under pressure, a heated mandrel 50 melts the post 25 ends onto inner member 40, thus holding the three components of the assembly in place. By varying the depth of the inside edge of the L-shaped step in outer member 20, or the number of posts 25, the head tension of even same size assemblies can be varied.

This method also provides for tensioning a drum head assembly 10 without requiring any glue or adhesive, yet placing adequate tension to produce a traditional drum sound, while allowing for all the tension to be self-contained in drum head assembly 10 with no stress being placed on the drum shell or frame.

The present invention having been thus been described with particular reference to the preferred forms thereof, it will be obvious that various changes and modifications may be made therein without departing from the spirit and scope of the present invention as defined in the appended claims.

What is claimed is:

1. A drum head assembly comprising:

an outer ring member being substantially L-shaped in cross section and having a first outer circumference and a first inner circumference;

an inner ring member being substantially L-shaped in cross section and having a second outer circumference and a second inner circumference; and a skin having a portion thereof positioned between said inner and outer ring members, and having a third outer circumference, wherein said outer ring member and said inner ring member can variably tension said skin, wherein said outer ring member has an inner surface having an L-shaped step, wherein said step has a first base surface and a first arm member, wherein said first arm member is substantially perpendicular to said first base surface, wherein said first base surface and said first arm member form an inside edge, wherein said inner ring member has a second base surface and a first plurality of apertures, and wherein said first base surface has a plurality of protrusion members.

2. The drum head assembly of claim 1, wherein said skin has a plurality of second apertures, and wherein said skin can be variably tensioned by pressing said second base surface towards said inside edge so that said plurality of protrusion members extend through said first plurality of apertures and through said second plurality of apertures.

3. The drum head assembly of claim 1, wherein the plurality of protrusion members have distal ends, said protrusion members being integrally connected to the first base surface and having a position at a radial distance away from said first outer circumference.

4. The drum head assembly of claim 3, wherein said inner surface of said outer ring member and said plurality of protrusion members are adapted to engage said skin and said inner ring member.

5. The drum head assembly of claim 3, wherein the distal ends of said plurality of protrusion members are melted to form a head on each of the said plurality of protrusion members.

6. The drum head assembly of claim 5, wherein said inner ring member has a plurality of C-shaped grooves, and wherein said heads do not extend axially outside of said plurality of C-shaped grooves.

7. The drum head assembly of claim 6, wherein said heads hold said inner ring member, said skin and said outer ring member tensioned in place.

8. The drum head assembly of claim 3, wherein said second base surface of said inner ring member is adapted to matingly engage concentrically said first base surface of said outer ring member.

9. The drum head assembly of claim 8, wherein said inner ring member has a second arm member on said second inner circumference, extending substantially perpendicularly from said second base surface.

10. The drum head assembly of claim 9, wherein said second arm member defines said second inner circumference when said outer ring member and said inner ring member are assembled to form the drum head assembly.

11. The drum head assembly of claim 9, wherein said first plurality of apertures extend axially through said second base surface and have a position at a radial distance away from said second outer circumference.

12. The drum head assembly of claim 11, wherein said first plurality of apertures are at least equal in number to said plurality of protrusion members.

13. The drum head assembly of claim 11, wherein said second arm member is integrally connected to said second inner circumference on a side of said first plurality of apertures that is most distal from said second outer circumference.

14. The drum head assembly of claim 11, wherein said inner ring member has a plurality of C-shaped grooves positioned about said first plurality of apertures on said second base surface, each of said plurality of C-shaped grooves surrounding a complementary aperture.

15. The drum head assembly of claim 14, wherein said plurality of C-shaped grooves are equal in number to said first plurality of apertures.

16. The drum head assembly of claim 14, wherein said skin has a second plurality of apertures, each of said second plurality of apertures having a position at a radial distance from said third outer circumference of said skin.

17. The drum head assembly of claim 16, wherein the position of said second plurality of apertures complementarily matches the position of said plurality of protrusion members and the position of said first plurality of apertures.

18. The drum head assembly of claim 17, wherein said skin is anchored by said plurality of protrusion members, wherein said plurality of protrusion members extend through said second plurality of apertures.

19. A drum head assembly comprising:

an outer ring member being substantially L-shaped in cross section and having a first outer circumference and a first inner circumference;

an inner ring member being substantially L-shaped in cross section and having a second outer circumference and a second inner circumference; and a skin having a portion thereof positioned between said inner and outer ring members, and having a third outer circumference, wherein said outer ring member and said inner ring member can variably tension said skin, and wherein said third outer circumference of said skin is greater than said first outer circumference of said outer ring member.

20. The drum head assembly of claim 19, wherein said second outer circumference is slightly less than said first inner circumference.

21. The drum head assembly of claim 19, wherein said outer ring member has an inner surface having an L-shaped step.

22. The drum head assembly of claim 21, wherein said step has a first base surface and a first arm member.

23. The drum head assembly of claim 22, wherein said first arm member is substantially perpendicular to said first base surface.

24. The drum head assembly of claim 23, wherein said first base surface and said first arm member form an inside edge.

25. The drum head assembly of claim 19, wherein said inner ring member has a complementary shape configuration to said outer ring member.

26. The drum head assembly of claim 19, wherein said inner ring member has an outer surface having an L-shaped member.

27. The drum head assembly of claim 19, wherein said skin has a plurality of radial slits along said third outer circumference.

28. The drum head assembly of claim 19, wherein said skin is secured between said outer ring member and said inner ring member.

29. The drum head assembly of claim 19, wherein said outer ring member has a decorative shape.

30. The drum head assembly of claim 19, wherein said inner ring member has a decorative shape.

31. The drum head assembly of claim 19, wherein said skin has a decorative shape.

32. The drum head assembly of claim 19, wherein said outer ring member is made from a rigid material.

33. The drum head assembly of claim 32, wherein said material is selected from the group consisting of plastic, metal, and any combinations thereof.

34. The drum head assembly of claim 19, wherein said inner ring member is made from a rigid material.

35. The drum head assembly of claim 34, wherein said material is selected from the group consisting of plastic, metal, and any combinations thereof.

36. The drum head assembly of claim 19, wherein said skin is made from a polyester film.

37. A drum head assembly comprising:

an outer ring member being substantially L-shaped in cross section and having an L-shaped step on an inner surface, said L-shaped step having a first arm member and a first base surface, said first base surface having a plurality of integrally connected protrusion members;

an inner ring member being substantially L-shaped in cross section and having a complementary shape configuration to said outer ring member, said inner ring member having an outer surface having an L-shaped member having a second arm member and a second base surface, said second base surface having a first plurality of apertures and being adapted to matingly engage concentrically said first base surface; and a skin having a portion thereof positioned between said inner and outer ring members, and having a second plurality of apertures, wherein said second plurality of apertures are positioned to complementarily match in position said plurality of protrusion members and said first plurality of apertures, said inner surface of said outer ring member and said plurality of protrusion members can engage said skin and said inner ring member, and wherein said outer ring member and said inner ring member can variably tension said skin.

38. A method for tensioning a drum head assembly comprising:

inserting a skin having a first plurality of apertures onto an outer ring member, said outer ring member having a first base surface and a first arm member defining an L-shaped step on an inner surface and said outer ring member having a plurality of protrusion members with distal ends integrally connected to said first base surface that are radially spaced and positionally adapted to engage said first plurality of apertures; and pressing an inner ring member having a second arm member, a second plurality of apertures positionally complementary to said first plurality of apertures and positionally complementary to said plurality of protrusion members and extending axially through a second base surface, said second arm member and said second base surface defining an L-shaped member on an outer surface, concentrically onto said skin and said outer ring member to create pressure.

39. The method of claim 38, further comprising pressing said inner ring member concentrically onto said first base surface.

40. The method of claim 38, further comprising pressing said inner ring member into an inside edge of said outer ring member.

41. The method of claim 38, further comprising pressing said second base surface towards said first base surface while said second arm member presses said skin to create a tension in said skin.

42. The method of claim 38, further comprising melting the distal ends of said protrusion members onto said inner ring member to hold the assembly in place.

43. The method of claim 38, further comprising adjusting the tension in said skin by varying the depth of said L-shaped step.

44. The method of claim 38, further comprising adjusting the tension in said skin by varying the radial spacing of said first plurality of apertures.

* * * * *